US008496549B2

(12) United States Patent
Couture

(10) Patent No.: US 8,496,549 B2
(45) Date of Patent: Jul. 30, 2013

(54) ARROWHEAD WITH IMPROVED LETHAL PENETRATING CAPABILITY

(76) Inventor: Gabriel Couture, Candiac (CA)

( * ) Notice: Subject to any disclaimer, the term of this patent is extended or adjusted under 35 U.S.C. 154(b) by 121 days.

(21) Appl. No.: 13/175,917

(22) Filed: Jul. 4, 2011

(65) Prior Publication Data

US 2012/0004057 A1 Jan. 5, 2012

Related U.S. Application Data

(60) Provisional application No. 61/361,120, filed on Jul. 2, 2010.

(51) Int. Cl.
*F42B 6/08* (2006.01)

(52) U.S. Cl.
USPC ..... 473/583

(58) Field of Classification Search
USPC ..... 473/578, 582, 583, 584
See application file for complete search history.

(56) References Cited

U.S. PATENT DOCUMENTS

D184,538 S * 3/1959 Santry ..... D22/115
5,064,202 A * 11/1991 Barner ..... 473/583
6,290,903 B1 9/2001 Grace, Jr. et al.
6,595,881 B1 7/2003 Grace, Jr. et al.
6,863,630 B1 * 3/2005 Watkins et al. ..... 473/583
RE40,273 E 4/2008 Grace, Jr. et al.
8,043,178 B2 * 10/2011 Sames ..... 473/583
8,167,748 B2 * 5/2012 Butcher ..... 473/583
2007/0026980 A1 2/2007 Grace, Jr. et al.

FOREIGN PATENT DOCUMENTS

WO WO 2005/043070 5/2005

* cited by examiner

*Primary Examiner* — John Ricci
(74) *Attorney, Agent, or Firm* — Benoît & Côté Inc.

(57) ABSTRACT

The present document describes an arrow/arrowhead which depart from the conventional concepts and designs of the prior art. The arrowhead described in the present embodiments allows for higher penetration coupled with a higher ability to snatch and/or isolate tissue from the animal body to take down animals as fast and as humanly as possible. In an embodiment, the arrowhead comprises a shaft having a pointed end and at least one lobe mounted on the shaft. When the arrowhead penetrates the animal's body, the lobe snatches the tissue from the animal's body, as opposed to only making a cut therein. When the tissue is snatched from the animal's body, excessive bleeding occurs, which prevents the animal from running away and suffering longer. In an embodiment, each lobe may include a blade forming a closed loop.

15 Claims, 6 Drawing Sheets

"PRIOR ART"

ARROWHEAD WITH IMPROVED LETHAL PENETRATING CAPABILITY

CROSS-REFERENCE TO RELATED APPLICATIONS

This application claims priority from U.S. Provisional Application No. 61/361,120 Filed on Jul. 2, 2010.

BACKGROUND (a) Field

The subject matter disclosed generally relates to hunting gear. More particularly, the description relates to arrowheads.

(b) Related Prior Art

Throughout history, archery has played a dominant role in hunting, warfare, and sports. Archery technology has developed tremendously since its origins thousands of years ago, and though not used for warfare anymore, archery remains a challenging sport which has its own particularities and requires skills from the hunter in order to produce a clean kill. Furthermore, some countries prohibit the use of firearms for hunting, and thus, archery remains the only alternative for hunting.

The technology of archery encompasses both launchers and projectiles. A bow (the launcher) is used to propel an arrow (the projectile) towards a target. A conventional arrow has a shaft, a nock that receives the bow string attached to the trailing end of the shaft, and an arrowhead or point attached to the leading end of the arrow shaft, which aids in penetrating the target. An arrowhead generally has a pointed forward end.

Quick and humane kills are dependent on accurate shot placement, and upon the amount or volume of the animal tissue that is cut. Hunting arrowheads that cut more tissue are more lethal, and therefore are better for both the hunter and the animal. The volume of tissue that is cut is determined by the cutting diameter of the arrowhead, the number of blades it contains, and by the depth the arrowhead penetrates into the animal.

FIG. 1 is a top plan view of a conventional arrowhead 10 including three blades 12 mounted on a shaft 14. When the arrowhead 10 hits the body of an animal, the blades 12 cut the tissue of the animal and cause bleeding.

The problem with the conventional arrowheads such as that shown in FIG. 1 is that even though it is aerodynamic, and even if the shot is successful, the animal is often able to run for quite some distance before it collapses as it succumbs to its wounds because the arrowhead does not snatch and isolate the tissue from the animal's body. Therefore, quite often the hunter looses the animal and the arrowhead shot at it and the animal suffers needlessly. Some animals are also able to recover from the wound and survive.

Several attempts have been made to increase the diameter of the shaft so that the shaft creates more damage in the animal's body, but these attempts have failed because the arrowhead becomes heavy and loses its aerodynamics.

Therefore, there is a need for an arrowhead which expedites the death of the animal, and reduces its pain and suffering.

SUMMARY

According to an aspect, there is provided an arrowhead comprising a shaft having a longitudinal axis, and at least one lobe mounted on the shaft, the at least one lobe defining a longitudinal opening in a direction that is substantially aligned with the longitudinal axis. The lobe is for snatching tissue from an animal's body in the longitudinal opening when the arrowhead penetrates the animal's body.

In an embodiment, each lobe includes two blades and an outer portion connected between the two blades forming a closed loop with the two blades.

The two blades may be parallel to each other, or may be provided at an angle that is less than 90 degrees relative to the longitudinal axis of the shaft.

The outer portion may have different shapes. For instance, the outer portion may be arc-shaped or circular. In an embodiment, the arrowhead includes two or more lobes. The lobes may be symmetrical to each other and/or provided at substantially equal angles with respect to the axis of the shaft (i.e., equally distributed around the shaft).

In another embodiment, the shaft has a pointed end. The lobe may have different shapes. For instance, the lobe may have an oval shape, a circular shape or the shape of an ellipse. The lobe may be detachably mounted on the shaft. In a further embodiment, the lobe includes a single blade forming a closed loop. In yet a further embodiment, the arrowhead is made in one piece. The arrowhead may be made of a single monolithic piece.

According to an embodiment, the at least one lobe includes one blade forming a closed loop.

According to another aspect, there is provided an arrowhead comprising a shaft; a circular portion having a diameter that is greater than the diameter of the shaft; and at least two blades connected between the shaft and the circular portion, the at least two blades forming at least two closed loops with the circular portion and the shaft. The at least two closed loops are for snatching tissue from an animal's body when the arrowhead penetrates the animal's body.

According to a further aspect, there is provided an arrow comprising: an elongated shaft; and an arrowhead mounted at one end of the elongated shaft; the arrowhead comprising: a pointed end; and at least two blades mounted on the elongated shaft; wherein at least one of the at least two blades defines a closed loop for snatching tissue from an animal's body when the arrowhead penetrates the animal's body.

In an embodiment, the arrowhead comprises two or more loops provided at substantially equal angles around the elongated shaft.

In another embodiment, the blades include cutouts in the walls thereof.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

The present document describes an arrow/arrowhead which depart from the conventional concepts and designs of the prior art. The arrowhead described in at least some of the present embodiments allows for high penetration coupled with the ability to snatch and/or isolate tissue from the animal's body to take down animals as fast and as humanly possible. In an embodiment, the arrowhead comprises a shaft having a pointed end and at least one lobe mounted on the shaft. When the arrowhead penetrates the animal's body, the lobe snatches the tissue from the animal's body, as opposed to only making a cut therein. When the tissue is snatched from the animal's body, excessive bleeding occurs, which prevents the animal from running away and suffering longer. In an embodiment, the lobe may include a blade forming a closed loop.

Figure 2:
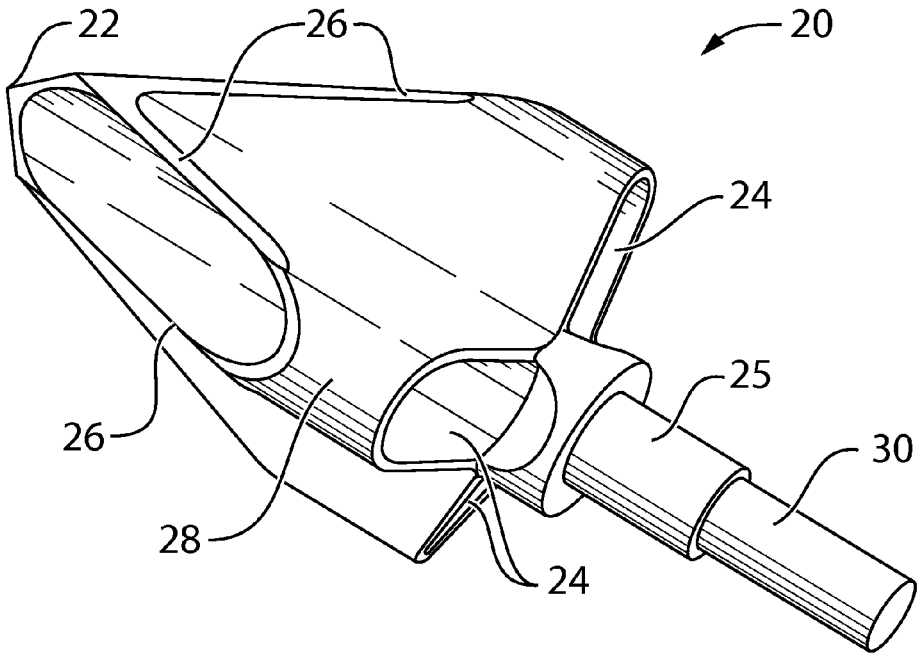
FIG. 2 illustrates an example of an arrowhead in accordance with an embodiment.
Figure 3:
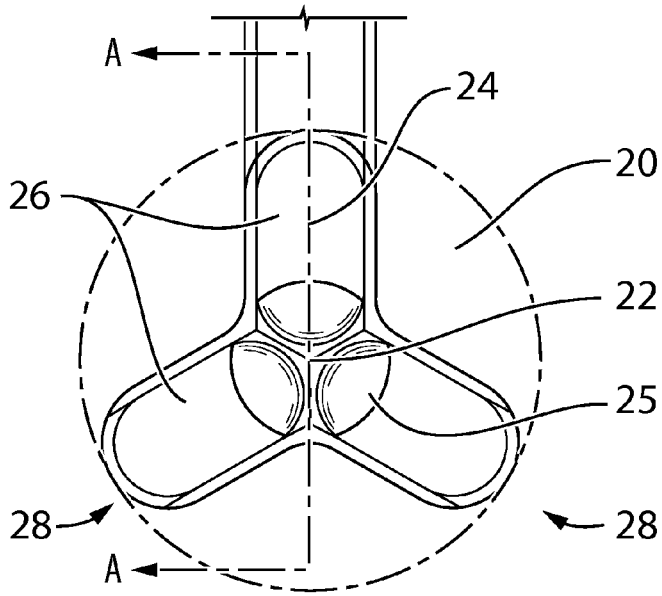
FIG. 3 is a top plan view of the arrowhead shown in FIG. 2.

Referring now to the drawings, and more particularly to FIG. 2, there is illustrated an example of an arrowhead 20 in accordance with an embodiment. FIG. 3 is a top plan view of the arrowhead 20 shown in FIG. 2. As shown in FIGS. 2 and 3, the arrowhead 20 includes a pointed end 22, and a plurality of lobes 24. The lobes 24 are mounted on a shaft 25. The lobes may have different shapes. In the example shown in FIGS. 2 and 3, each lobe 24 includes at least two blades 26 and an outer portion 28 defining at least one closed loop. Although the embodiments of FIGS. 2 and 3 show the lobe as being made of two blades 26 and an outer portion 28, it should be noted that the lobe may be made from a single blade which forms a closed loop.

Figure 1:
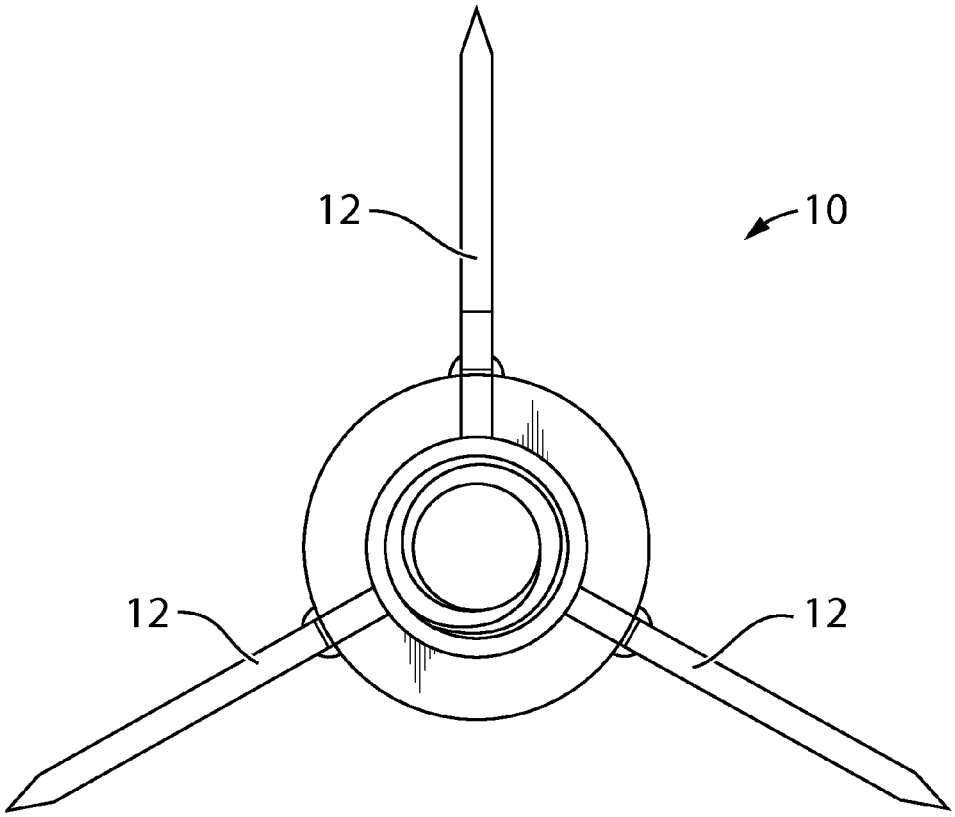
FIG. 1 is a top plan view of a prior art conventional arrowhead including three blades mounted on a shaft.

The arrowhead 20 has improved aerodynamics and precision because air can pass through the lobes without adding air resistance or weight to the arrowhead. At the same time, when an arrowhead in accordance with the embodiments of the present application hits the body of an animal and penetrates therein, the lobes 24 snatch the tissue from the animal's body and separate it from the body, whereby, the loop formed by the inner walls of the blades 26 and the outer portion 28 surround the tissue which is cut and separate it from the body. Contrarily, the conventional arrowhead such as that shown in FIG. 1, just makes a cut and prolongs the animal's escape and suffering. When the tissue is snatched and isolated, more bleeding occurs and the animal collapses faster without being able to run and/or hide far away.

The shaft 25 may include a portion 30, as shown in FIG. 2, which is threaded for attaching/detaching to an arrow. In an embodiment, the lobes 24 may be detachably mounted on the shaft 25, whereby the user may choose the number of lobes to use in the arrowhead. This way, the user may re-use the lobes that are in good condition if the arrowhead was found after being shot.

FIGS. 2 and 3 show the blades 26 as being parallel to each other. However, the arrowhead is not limited to this embodiment. It is also contemplated that the blades may be provided at different angles within the lobe; i.e., the angle of the blade relative to the shaft. In some embodiment, the blades are not straight. The blades can be arc-shaped. Furthermore, the lobes may have different shapes. For example, the lobe may have a circular shape, an oval shape, or the shape of an ellipse.

Figure 4:
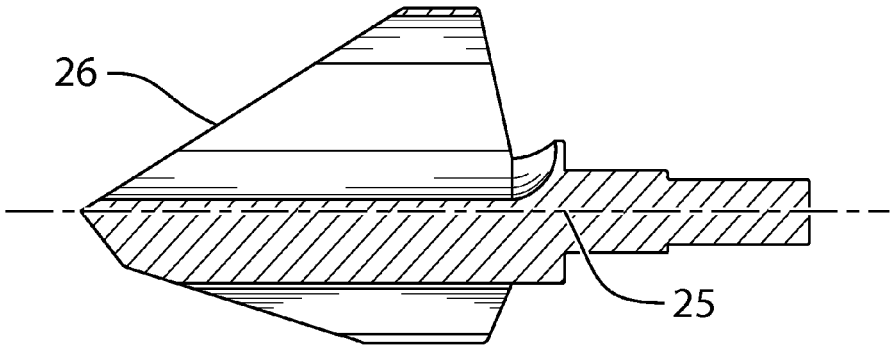
FIG. 4 is a cross sectional view of the exemplary arrowhead of FIG. 2 shown along the lines A-A of FIG. 3.

FIG. 4 is a cross-sectional view of the exemplary arrowhead 20 shown along the lines A-A of FIG. 3. In the embodiment shown in FIG. 4, the blades 26 make an angle of approximately 30 degrees with the shaft 25. However, the blade angle is not limited to an angle of 30 degrees. It is contemplated that the angle between the blades 26 and the shaft 25 may be in a range of 15 to 80 degrees.

In an embodiment, the outer portion 28 is arc-shaped as shown in FIG. 3. However, the lobe is not limited to only an arc-shaped outer portion 28. It is also contemplated that other shapes may be used to make a closed loop.

Figure 5:
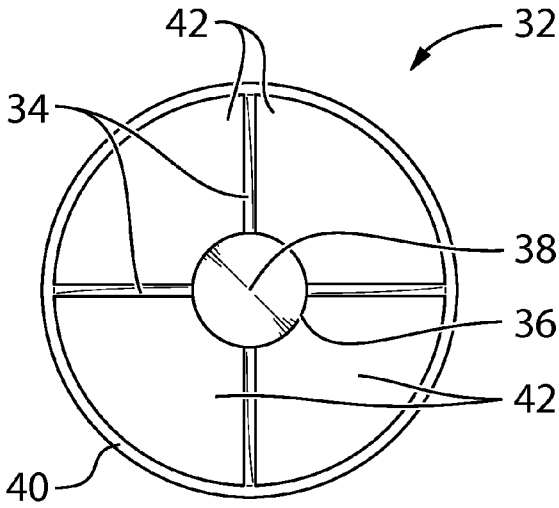
FIG. 5 is a top plan view of an arrowhead in accordance with another embodiment.

Furthermore, it is also contemplated that the outer portion 28 may be provided in a circular shape, as shown for example in FIG. 5. FIG. 5 is a top plan view of an arrowhead in accordance with another exemplary embodiment. FIG. 5 illustrates an arrowhead 32 including a plurality of blades 34, in this example four, mounted on a shaft 36. The arrowhead has a pointed end 38, and a circular portion 40 defining a plurality of lobes 42 with the blades 34.

The arrowhead includes at least one lobe forming a closed loop for snatching tissue from the animal's body when penetrating therein. While FIGS. 2 and 3 show an arrowhead 20 including three lobes 24, it should be noted that the design is not limited to three lobes only. It is also contemplated that any number of lobes may be used which is equal to or greater than one.

Figure 6:
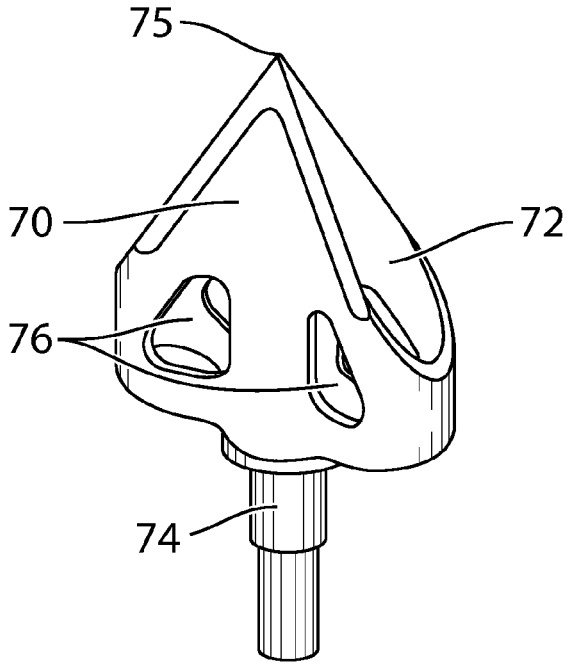
FIG. 6 illustrates another example of an arrowhead in accordance with an embodiment.
Figure 7:
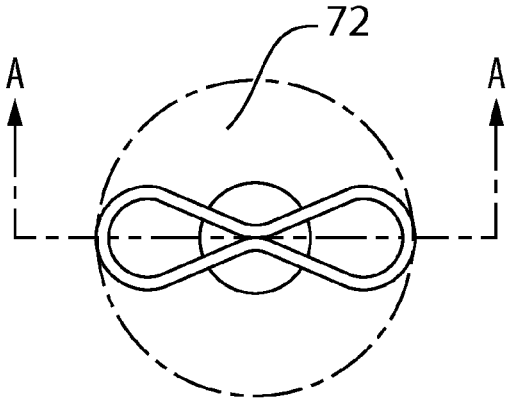
FIG. 7 is a top plan view of the arrowhead shown in FIG. 6.
Figure 8:
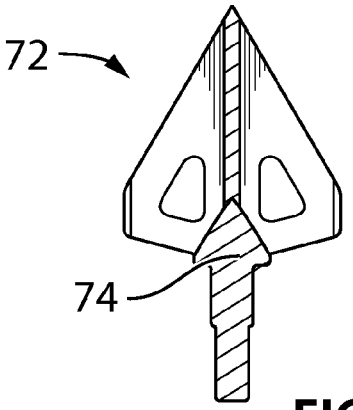
FIG. 8 is a cross sectional view of the exemplary arrowhead of FIG. 6 shown along the lines A-A of FIG. 7.

For instance, FIG. 6 illustrates another example of an arrowhead in accordance with a further embodiment. As shown in FIG. 6, the arrowhead 70 comprises two lobes 72 which are symmetrical with respect to the shaft 74 of the arrowhead 70, and a pointed head 75. In an embodiment, the lobes 72 define openings 76 (aka cutouts) in the walls thereof for reducing the weight of the arrowhead 70. FIG. 7 is a top plan view of the arrowhead shown in FIG. 6, and FIG. 8 is a cross sectional view of the exemplary arrowhead of FIG. 6 shown along the lines A-A of FIG. 7.

Figure 9:
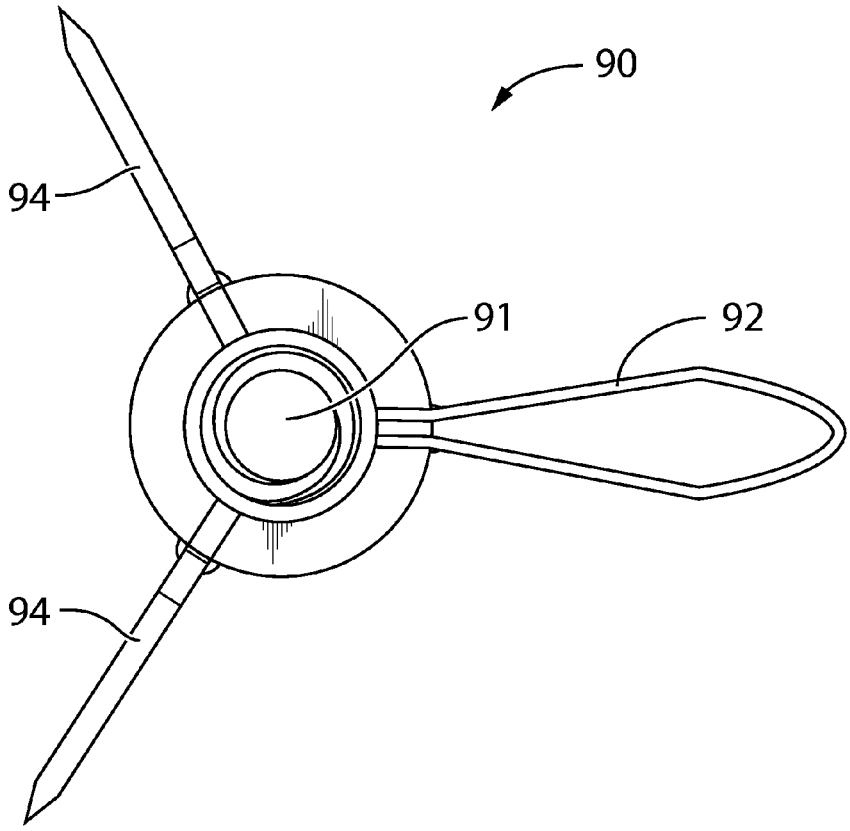
FIG. 9 is top plan view that illustrates another embodiment, in which the arrowhead comprises only one lobe defining a closed loop.

FIG. 9 illustrates another embodiment, in which the arrowhead comprises only one lobe defining a closed loop. As shown in FIG. 9, the arrowhead 90 comprises conventional blades 94 attached to the shaft 91 and one lobe 92 defining a closed loop.

An arrowhead in accordance with the present embodiments may be made in different ways and in different fabrication processes. For instance, the arrowhead may be made in one piece or in different pieces. In an embodiment, the arrowhead may be made of a single monolithic piece.

Figure 10:
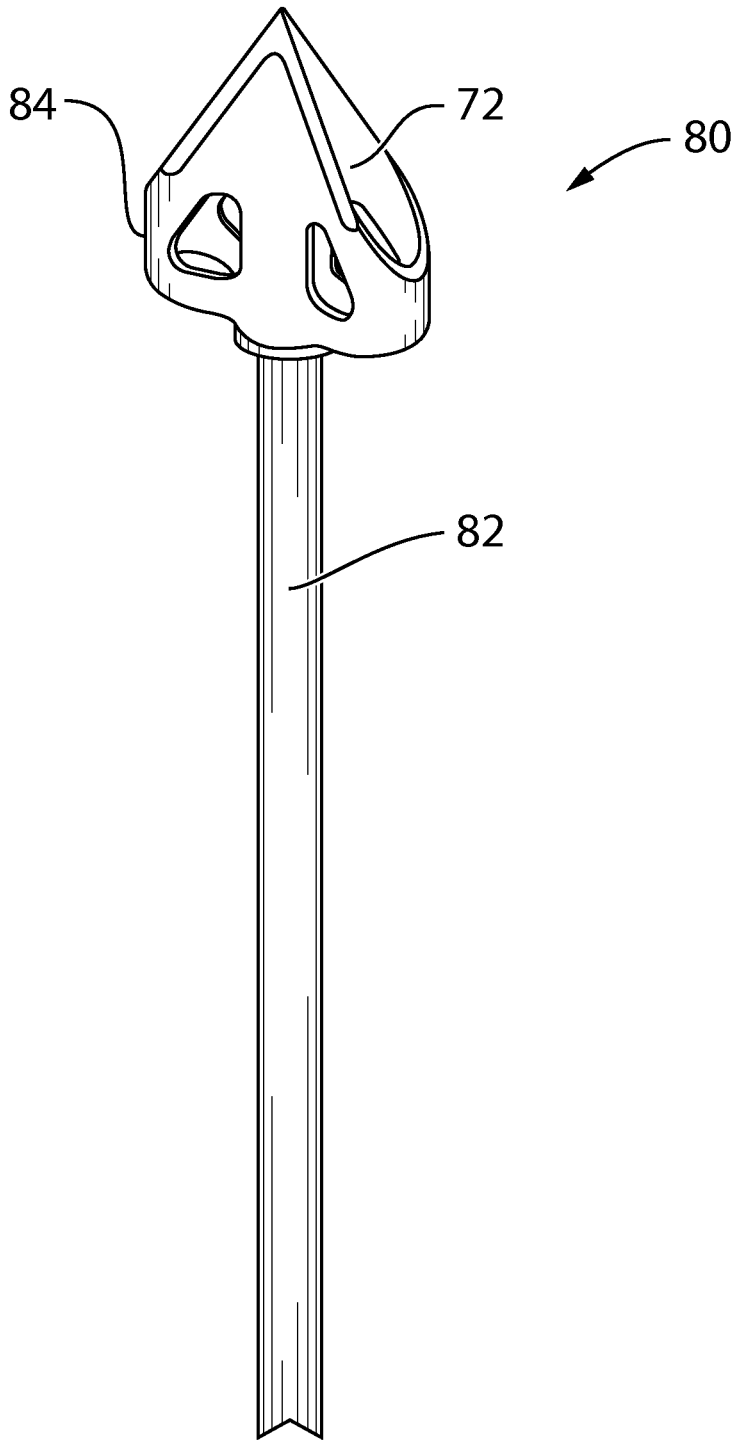
FIG. 10 is a perspective view of an exemplary arrow in accordance with an embodiment.

FIGS. 2 to 8 illustrate an arrowhead for mounting to the shaft of an arrow. FIG. 10 is a side view of an exemplary arrow in accordance with an embodiment. As shown in FIG. 10, the arrow 80 comprises an elongated shaft 82, and an arrowhead 84 mounted on one end of the shaft 82. The arrowhead 84 comprises at least one lobe 72 mounted to the shaft 82 of the arrow 80.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. An arrowhead comprising:

a shaft having a longitudinal axis; and at least one lobe mounted on the shaft, the at least one lobe defining a longitudinal opening in a direction that is substantially aligned with the longitudinal axis;

the at least one lobe for snatching tissue from an animal's body in the longitudinal opening when the arrowhead penetrates the animal's body wherein the at least one lobe includes one blade forming a closed loop.

2. The arrowhead of claim 1, wherein the at least one lobe includes two blades and an outer portion connected between the two blades forming a closed loop with the two blades.

3. The arrowhead of claim 2, wherein the two blades are provided at an angle that is less than 90 degrees with the longitudinal axis.

4. The arrowhead of claim 2, wherein the outer portion comprises one of an arc-shape, and a circular shape.

5. The arrowhead of claim 1, wherein the arrowhead includes two or more lobes substantially equally distributed around the shaft.

6. The arrowhead of claim 1, wherein the shaft has a pointed end.

7. The arrowhead of claim 1, wherein the at least one lobe comprises one of an oval shape, a circular shape, and an ellipse shape.

8. The arrowhead of claim 1, wherein the at least one lobe comprises an attachment portion for detachable mounting on the shaft.

9. The arrowhead of claim 1, wherein the at least one lobe comprises a single blade forming a closed loop.

10. The arrowhead of claim 1, wherein the arrowhead is made in one piece.

11. The arrowhead of claim 10, wherein the arrowhead is made of a single monolithic piece.

12. An arrowhead comprising:

a shaft having a longitudinal axis; and at least one lobe mounted on the shaft, the at least one lobe defining a longitudinal opening in a direction that is substantially aligned with the longitudinal axis;

the at least one lobe for snatching tissue from an animal's body in the longitudinal opening when the arrowhead penetrates the animal's body; wherein the at least one lobe includes two blades and an outer portion connected between the two blades forming a closed loop with the two blades, and wherein the two blades are parallel to each other.

13. An arrow comprising:

an elongated shaft; and an arrowhead mounted at one end of the elongated shaft;

the arrowhead comprising at least one lobe mounted on the shaft, the at least one lobe defining a longitudinal opening in a direction that is substantially aligned with the longitudinal axis;

the at least one lobe for snatching tissue from animal's body in the longitudinal opening when the arrowhead penetrates the animal's body wherein the at least one lobe includes one blade forming a closed loop.

14. An arrow according to claim 13, wherein the arrowhead comprises two or more lobes substantially equally distributed around the elongated shaft.

15. An arrow according to claim 13, wherein the blade comprises a wall having openings therein.

* * * * *